US007559545B2

(12) United States Patent
Asada

(10) Patent No.: US 7,559,545 B2
(45) Date of Patent: Jul. 14, 2009

(54) SHEET FEEDER

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 435 days.

(21) Appl. No.: 11/071,151

(22) Filed: Mar. 4, 2005

(65) Prior Publication Data

US 2005/0194732 A1 Sep. 8, 2005

(30) Foreign Application Priority Data

Mar. 5, 2004 (JP) ..... 2004-061819

(51) Int. Cl.
*B65H 3/06* (2006.01)

(52) U.S. Cl. ..... 271/117; 271/118

(58) Field of Classification Search ..... 271/113, 271/114, 117, 118

See application file for complete search history.

(56) References Cited

U.S. PATENT DOCUMENTS 5,370,469 A 12/1994 Mutou et al.
6,257,569 B1 * 7/2001 Rhodes et al. ..... 271/117
6,581,924 B2 6/2003 Gaarder et al.
2002/0054381 A1 5/2002 Iwase

FOREIGN PATENT DOCUMENTS

JP 06-015938 A 1/1994
JP 2002-60068 A 2/2002
JP 2002-167060 A 6/2002
JP 2003-002463 A 1/2003

OTHER PUBLICATIONS

Japanese Office Action in Application No. JP2004-061819.

* cited by examiner

*Primary Examiner*—Kaitlin S Joerger
(74) *Attorney, Agent, or Firm*—Banner & Witcoff, Ltd

(57) ABSTRACT

A sheet feeder includes; a sheet feed roller that abuts against a topmost sheet of stacked sheets and rotates to convey the topmost sheet in a conveyance direction; an arm spanning across a drive shaft and the sheet feed roller; a rotating transmission member that transmits rotation of the drive shaft to the sheet feed roller, wherein the arm is provided with a cantilever shaft that supports the rotating transmission member, and an elastic member that faces an end face of the rotating transmission member to retain the rotating transmission member in the cantilever shaft.

19 Claims, 13 Drawing Sheets

SHEET FEEDER

BACKGROUND OF THE INVENTION

1. Field of the Invention

The present invention relates to a sheet feeder in an image forming apparatus, such as a printer, a copying machine, or a facsimile machine.

2. Description of the Related Art

The image forming apparatus, such as a printer, has a sheet feeder for feeding a single sheet of cut sheets at a time to a recording section. The sheet feeder is configured as follows. A sheet feed roller is rotated by means of power supplied from a power source, and brought into contact with the cut sheets on a sheet feed cassette having been set in the image forming apparatus, thereby feeding to the recording section a topmost sheet of the cut sheets (see, e.g., U.S. Patent Publication No. U.S. 2002/0054381A1 corresponding to JP-A-2002-060068).

SUMMARY OF THE INVENTION

A sheet feeder is configured to transmit power supplied from the power source to the sheet feed roller by means of a gear system, and the like. However, a rotating member, such as a gear, has conventionally been attached to the inside of a gear box by means of a fastener; e.g., a screw, pin, and the like. Accordingly, there arises a problem that a variety of fasteners, such as a screw, must be prepared, along with a problem that operations for assembling the sheet feeder become complicated.

It is therefore one of objects of the present invention to provide a sheet feeder which solves the above problems.

According to a first aspect of the invention, there is provided a sheet feeder including: a sheet feed roller that abuts against a topmost sheet of stacked sheets and rotates to convey the topmost sheet in a conveyance direction; an arm spanning across a drive shaft and the sheet feed roller; a rotating transmission member that transmits rotation of the drive shaft to the sheet feed roller, wherein the arm is provided with a cantilever shaft that supports the rotating transmission member, and an elastic member that faces an end face of the rotating transmission member to retain the rotating transmission member in the cantilever shaft.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Hereinafter, preferred embodiments of the present invention will be described by reference to the drawings.

First Embodiment

Figure 1:
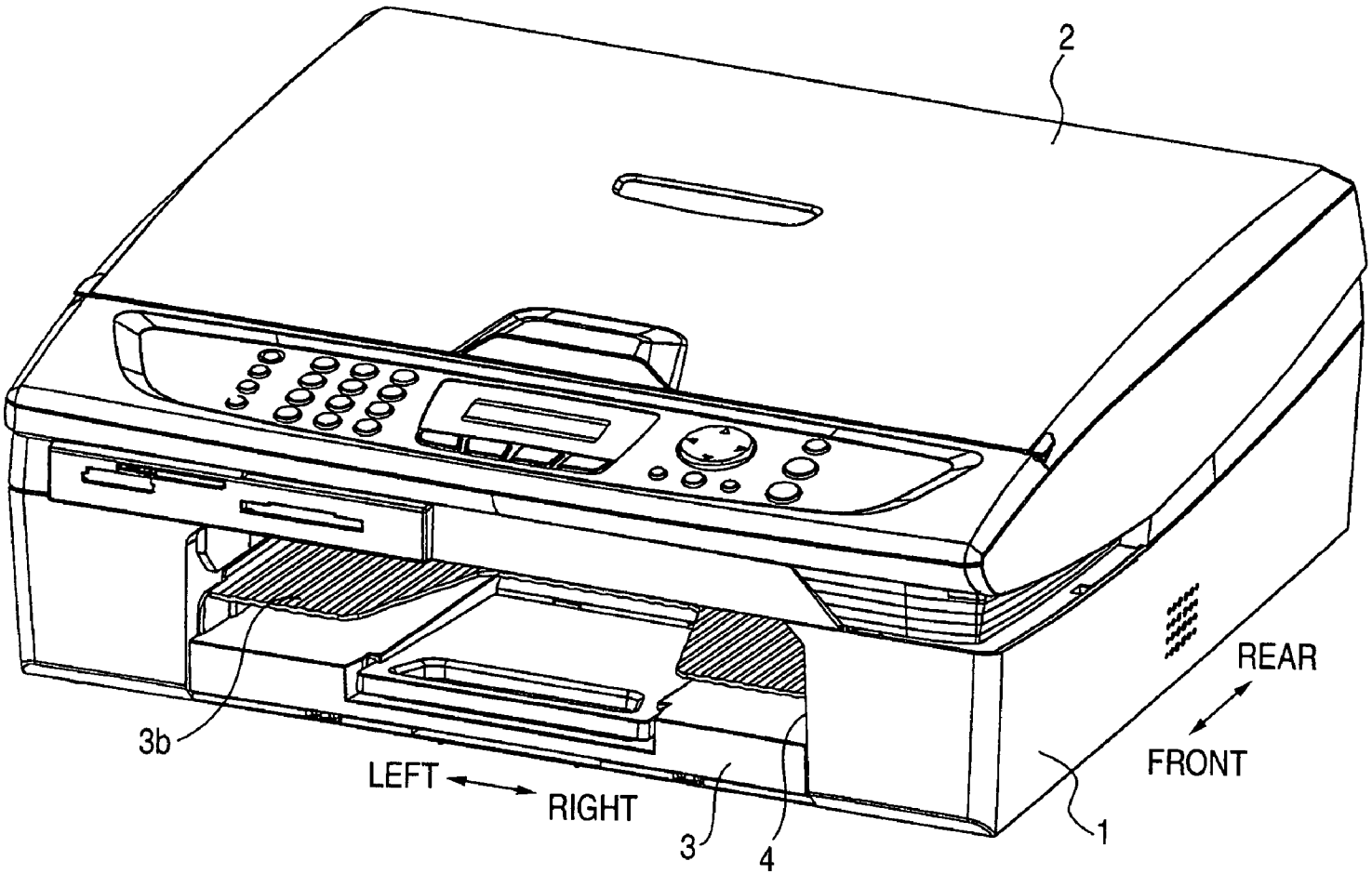
FIG. 1 is a perspective view of a printer using a sheet feeder according to the present invention.
Figure 2:
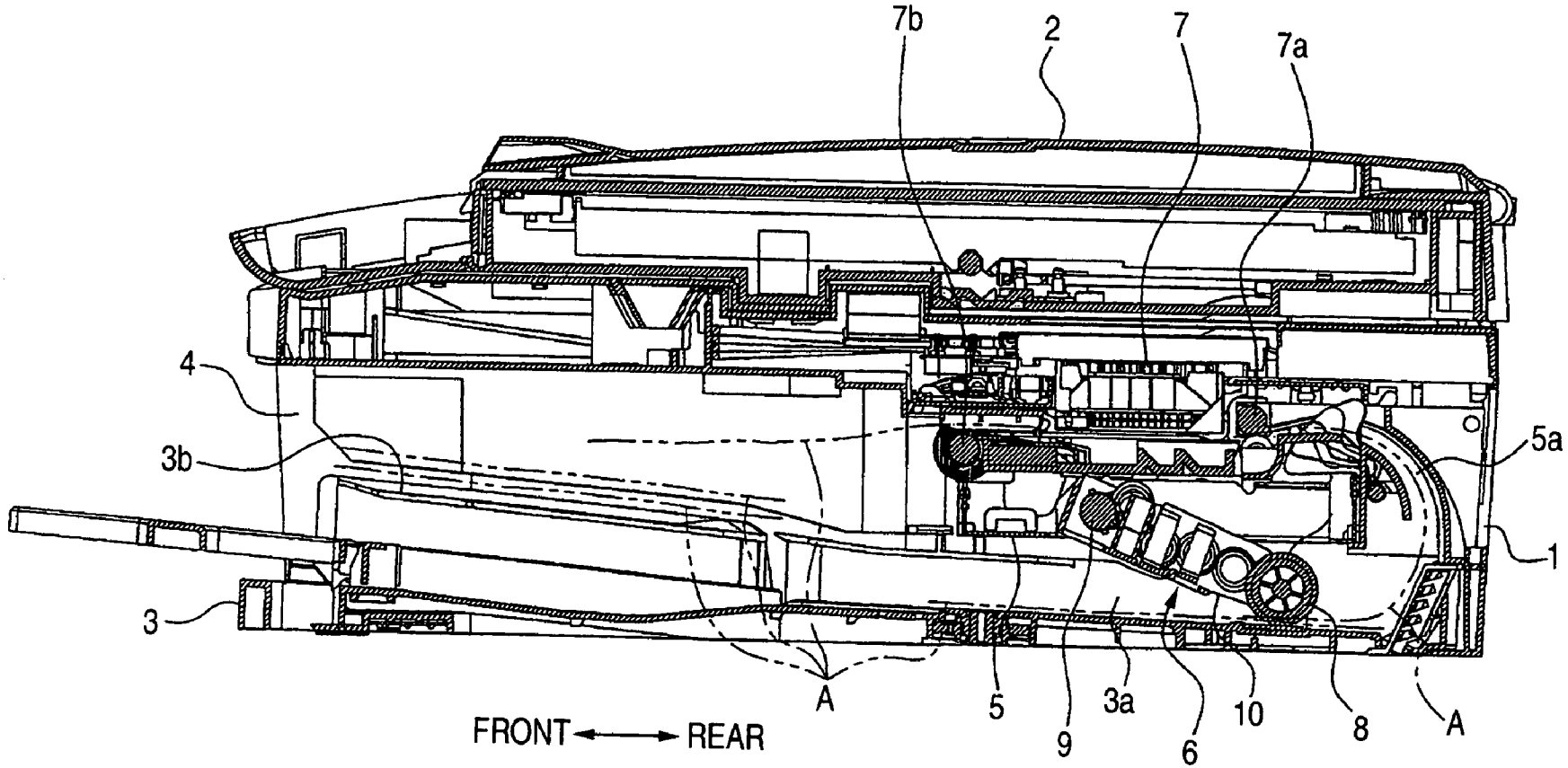
FIG. 2 is a vertical cross-sectional view of the printer shown in FIG. 1.

A printer according to a first embodiment is configured as a multifunction machine as shown in FIGS. 1 and 2, and has a scanner 2 on the top of a case 1 thereof.

Figure 3:
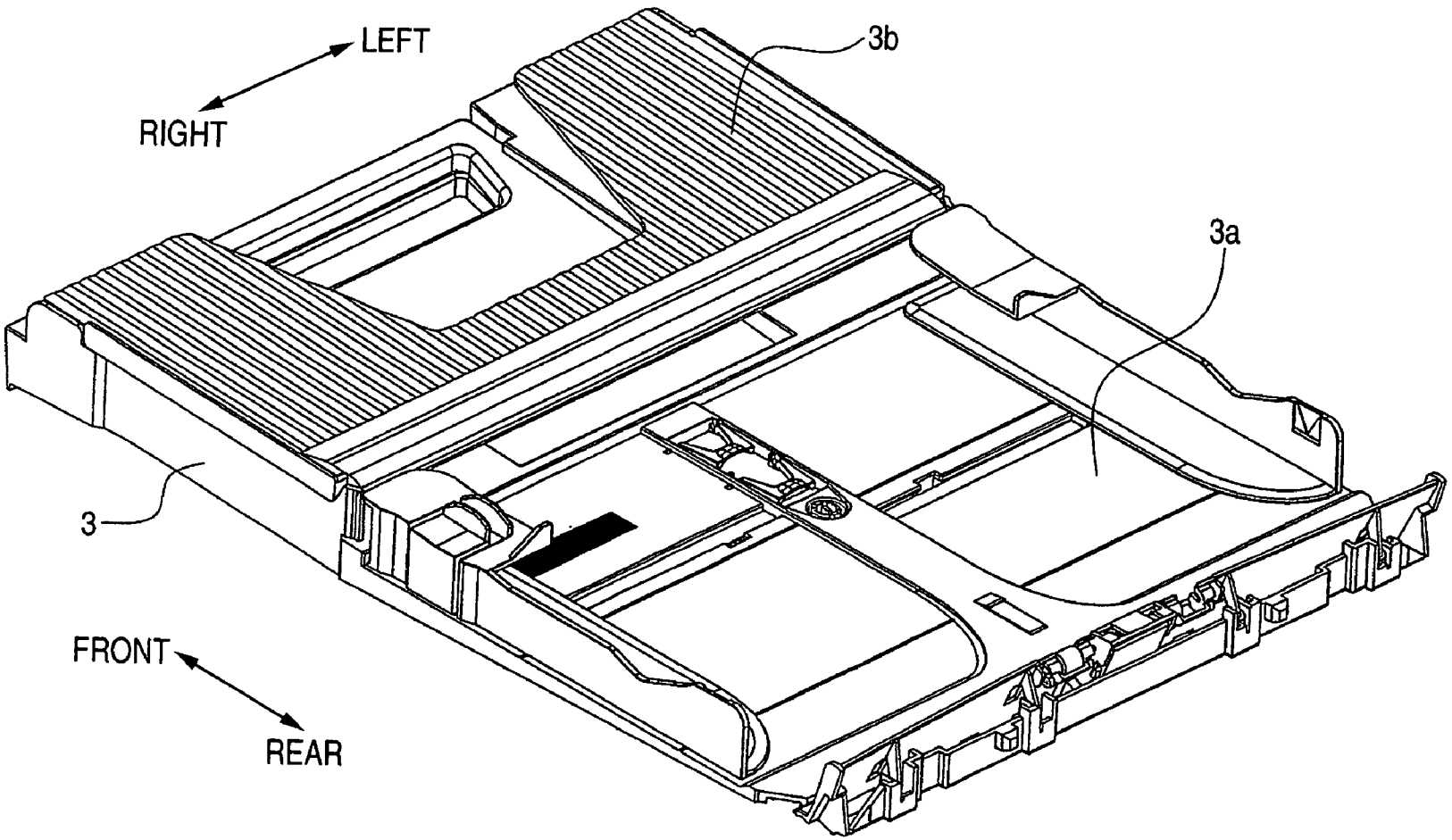
FIG. 3 is a perspective view of a sheet feed cassette to be attached to the printer shown in FIG. 1.

As shown in FIGS. 1 and 2, the printer has a sheet feed cassette 3 at a lower section in the case 1. The sheet feed cassette 3 has an appearance as shown in FIG. 3, and is inserted in the case 1 through an opening 4 in such a manner as to allow insertion and removal in the front-rear direction. A recessed section 3*a* for storing stacked sheets A is provided in the sheet feed cassette 3. When the sheet feed cassette 3 is inserted in the case 1, a sheet feed roller, which will be described later, is located on a topmost one of the sheets A in the recessed section 3*a*. A tray 3*b* for receiving the sheet A, on which an image has been recorded as will be described later, is formed in the front portion of the sheet feed cassette 3.

As shown in FIG. 2, a metal frame 5 of a box-like shape is disposed at the rear inside the case 1 and above the paper cassette 3. The frame 5 is of a rectangular solid shape elongated in the lateral direction (see FIG. 1), and fixed to the inside is of the case 1.

A sheet feeder 6 is disposed at the lower section in the frame 5, and a recording section 7 is disposed at the upper section in the same. In addition, in the rear of the frame 5, there is formed a guide path 5*a* for guiding the sheet A from the rear of the sheet feed cassette 3 to the recording section 7. The recording section 7 is specifically a recording device of an inkjet type. The recording section 7 has guide rollers 7*a* at positions adjacent to an exit of the guide path 5*a*, and discharge rollers 7*b* at positions for discharging the sheet A, on which an image has been recorded. A recording device of an inkjet type of such a configuration is conventionally known, and detailed description thereof is omitted.

A discharge section to which the sheet A is discharged from the recording section 7 is disposed in front of the frame 5 in the case 1. The sheet A discharged in the discharge section is stacked on the tray 3*b* in the sheet feed cassette 3.

As shown in FIGS. 2, and 4 to 6B, the sheet feeder 6 has a sheet feed roller 8 for feeding the sheet A in the sheet feed cassette 3 to the recording section 7. The sheet feed roller 8 is rotatably held at a tip end of an arm 10 which is supported by a drive shaft 9. The sheet feed roller rotates by means of power transmitted by way of a gear, which will be described later and which serves as a rotating transmission member, from the drive shaft 9.

The drive shaft 9 is rotatably supported in the frame 5 so as to extend laterally. A gear 11 is fixed on one end of the drive shaft 9. An output shaft of a drive source, such as a motor (not shown), is connected to the gear 11 to form a power line. When the drive source is activated and the drive shaft 9 rotates, the rotation is transmitted to the sheet feed roller 8 by way of the gear 11, which will be described later and which serves as the rotating transmission member. The sheet feed roller 8 is brought into contact with a topmost one of the sheets A in the sheet feed cassette 3, to thus feed the topmost one of the sheets A to the recording section 7.

The rotating transmission member for transmitting the rotation of the drive shaft 9 to the sheet feed roller 8 is specifically constituted as a gear train. The gear train includes a leading gear 12 formed on the other end of the drive shaft 9, a terminal gear 13 fixed on one end of the sheet feed roller 8, and first to fourth intermediate gears 14*a*, 14*b*, 14*c*, and 14*d* disposed between the leading gear 12 and the terminal gear 13. The first to fourth intermediate gears 14*a*, 14*b*, 14*c*, and 14*d* are held by the arm 10 together with the sheet feed roller 8. In the embodiment, four intermediate gears have been provided; however, as a matter of course, less than or more than four intermediate gears may be provided.

The arm 10 is configured so as to act as a pivotal link having the drive shaft 9 as a pivot. More specifically, a base section of the arm 10 is loosely fitted on the drive shaft 9, and enters and exits from the frame 5 by way of an opening formed in a bottom plate of the frame 5. When, as will be described later, when the drive shaft 9 rotates in one direction, the arm 10 rotationally exits the opening as shown in FIG. 2, thereby causing the sheet feed roller 8 to descend onto the sheet feed cassette 3; and when the drive shaft 9 rotates in the opposite direction, the arm 10 moves rotationally upward, thereby being stored in the frame 5 together with the sheet feed roller 8 through the opening.

The arm 10 also functions as a gear box. More specifically, the arm 10 is formed into a substantially box-shape whose top is open. The gear train ranging from the leading gear 12 to the terminal gear 13 is stored in the box.

Figure 6A:
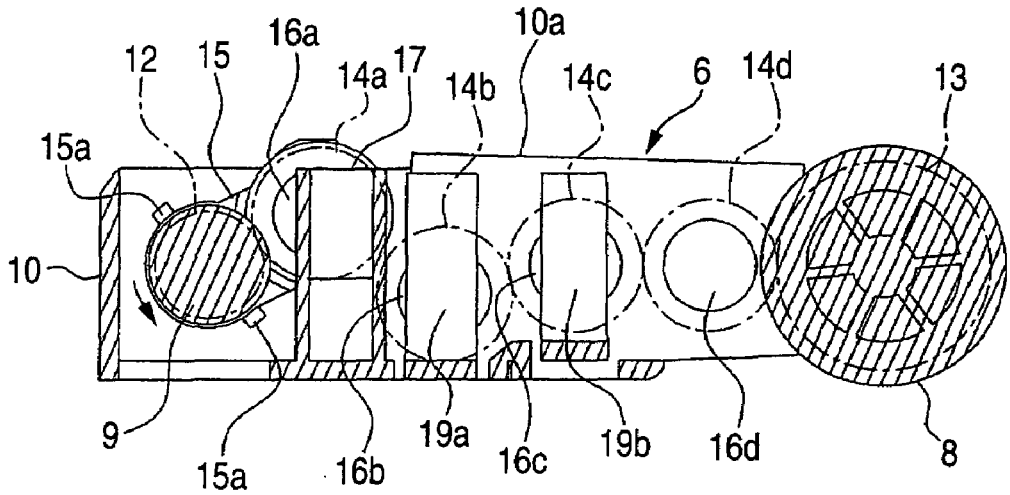
FIG. 6A is a vertical cross-sectional view of the sheet feeder showing a state where the sheet feeder does not feed paper.
Figure 6B:
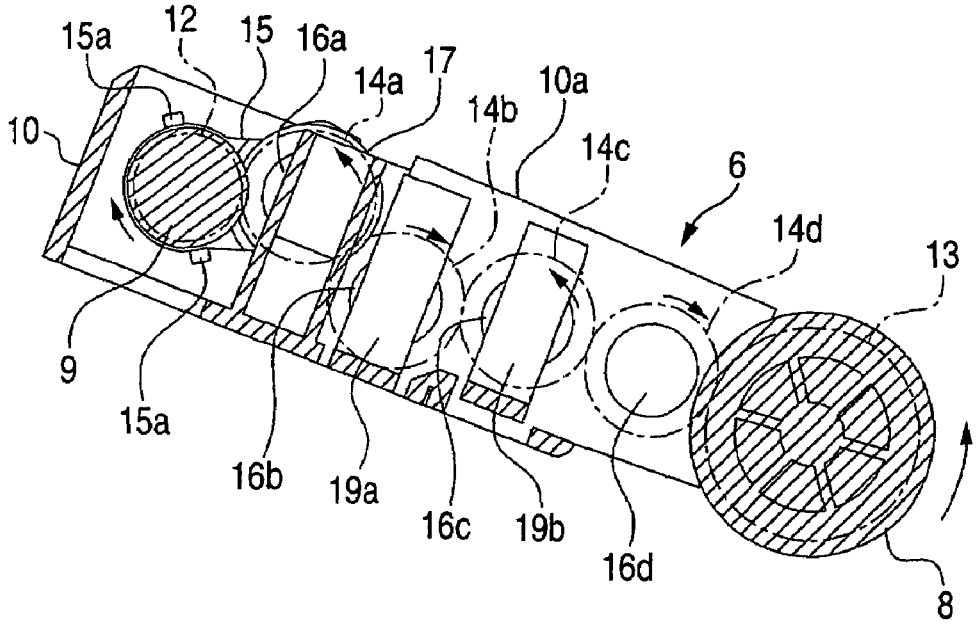
FIG. 6B is the same showing a state where the sheet feeder feeds paper.
Figure 7:
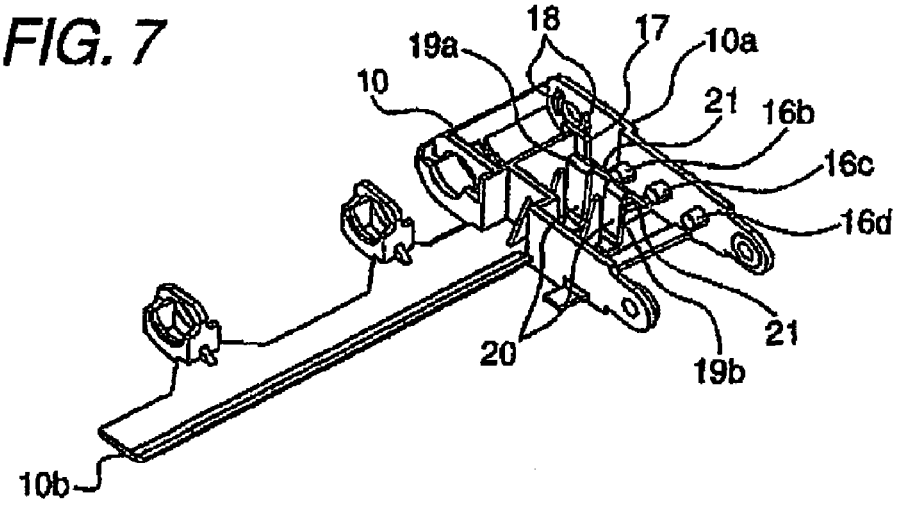
FIG. 7 is a perspective view of an arm of the sheet feeder.

The first intermediate gear 14*a*, which comes into engagement with the leading gear 12, functions as a clutch. One end of a shaft 16*a* of the first intermediate gear 14*a* is supported by a carrier 15, which is attached to the drive shaft 9 in a rotationally movable manner; and the other end is restricted, in terms of a rotationally-movable range, by a pressing plate 17 disposed in the arm 10. The carrier 15 is formed into a plate-shape, and is sandwiched between an end face of the leading gear 12 and a side wall 10*a* of the arm 10 with an appropriate pressure. In addition, interlocking means is disposed between the carrier 15 and the end face of the leading gear 12 for increasing a frictional coefficient therebetween. The interlocking means can be provided by means of, for instance, sandwiching a rubber sheet between the carrier 15 and the leading gear 12. According to the above configuration, when the drive shaft 9 rotates counterclockwise as shown in FIG. 6A, the carrier 15 is caused to rotate in the same direction with the drive shaft 9 by means of a frictional force, whereby the first intermediate gear 14*a* is separated from the second intermediate gear 14*b*, to thus cut-off transmission of power. When the drive shaft 9 rotates clockwise as shown in FIG. 6B, the carrier 15 is caused to rotate in the same direction with the drive shaft 9 by means of a frictional force, whereby the first intermediate gear 14*a* comes into engagement with the second intermediate gear 14*b*, thereby enabling transmission of power.

Figure 5A:
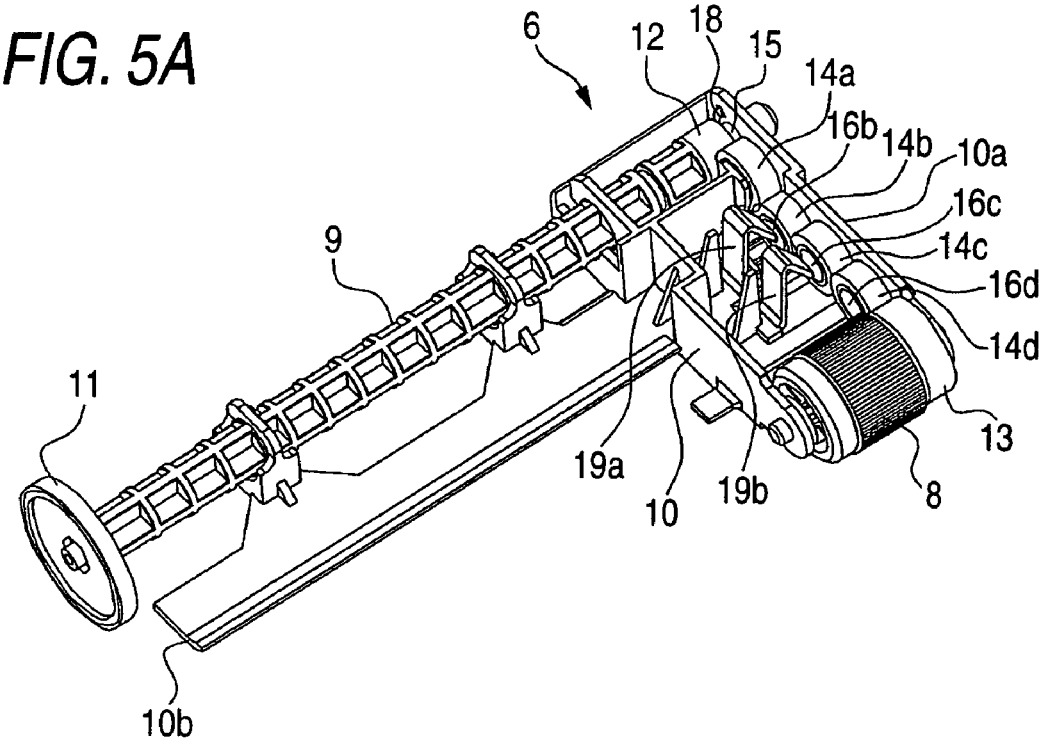
FIGS. 5A and 5B are perspective views of the sheet feeder as viewed from different directions.
Figure 5B:
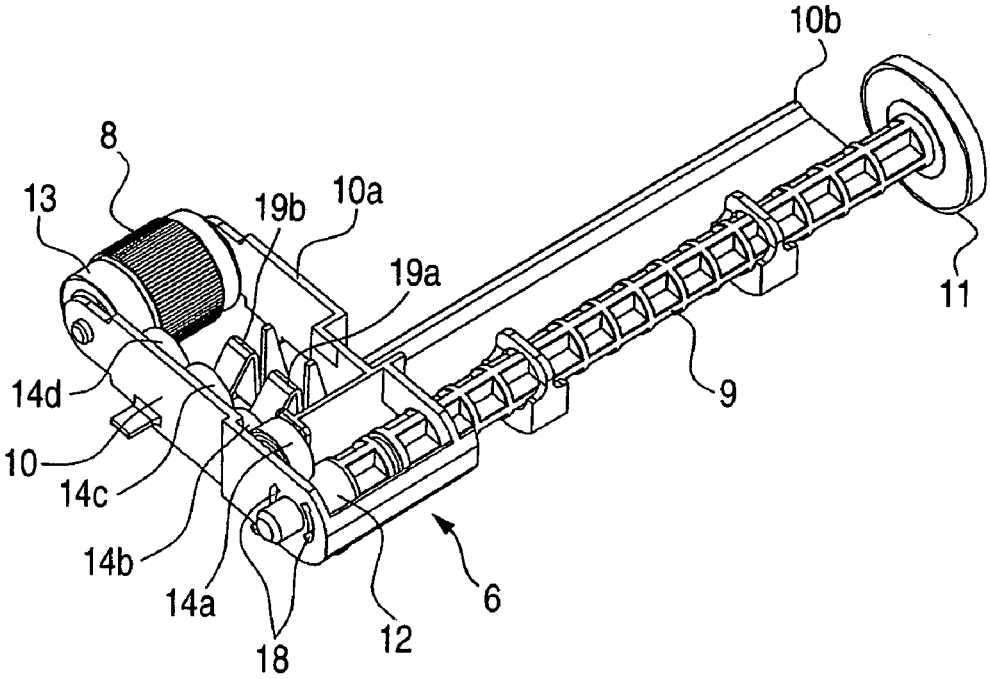

Furthermore, as shown in FIGS. 5A and 6S, protrusions 15*a* protruding toward the side wall 10*a* of the arm 10 are disposed on the carrier 15. As shown in FIG. 5B, each of the protrusions 15*a* fits in one of arc grooves 18 which are formed in the side wall 10*a* of the arm 10 and which are curved about the drive shaft 9. By virtue of the above configuration, when the drive shaft 9 rotates counterclockwise as shown in FIG. 6B, the carrier 15 is caused to rotate in the same direction with the drive shaft 9 by means of a frictional force. Accordingly, the first intermediate gear 14*a* is separated from the second intermediate gear 14*b*, as shown in FIG. 6G; and each of the protrusions 15*a* on the carrier 15 hits one end of the corresponding arc groove 18, thereby raising the arm 10 to its uppermost position as shown in FIG. 6A.

The second, third, and fourth intermediate gears 14*b*, 14*c*, and 14*d* are rotatably fitted on shafts 16*b*, 16*c*, and 16*d* respectively protruding from an inner face of the side wall 10*a* of the arm 10 in such a manner that one end of each of the respective shafts is supported by the inner wall; i.e., in cantilever fashion. Preferably, the arm 10 is molded of a synthetic resin, and at the time of molding, the shafts 16*b*, 16*c*, and 16*d* are molded simultaneously and integrally with the arm 10.

As shown in FIGS. 5A, 5B, and FIG. 7A to FIG. 8A, plate springs 19*a*, 19*b*, which are elastic members, are attached to inside the arm 10 so as to face the end faces of the gears 14*b* and 14*c* on the shafts 16*b* and 16*c*. Each of the plate springs 19*a*, 19*b* has an upright section 20 which extends upward from a bottom wall of the arm 10, and a bent section 21 which extends in a downwardly-oblique direction from an upper end of the upright section toward a front end of the shaft 16*b*, 16*c*. A tip end of the bent section 21 of each of the plate springs 19*a*, 19*b* faces the end face of the corresponding gear 14*b*, 14*c* on the corresponding shaft 16*b*, 16*c*, and preferably faces the center of the end face. In the illustrated example, the tip end of the bent section 21 of each of the plate springs 19*a*, 19*b* is slightly separated from the end face of the gear 14*b*, 14*c* or from the tip end of the shaft; however, the tip end of the bent section 21 may be brought into contact therewith. As in the case of the shafts 16*b*, 16*c*, and 16*d*, the plate springs 19*a*, 19*b* are preferably molded simultaneously and integrally with the arm 10. Assembly of the second intermediate gear 14*b* and the third intermediate gear 14*c* is performed as follows. The intermediate gears 14*b*, 14*c* are inserted between the tip ends of the shafts 16*b*, 16*c* and the plate springs 19*a*, 19*b*. Accordingly, the intermediate gears 14*b*, 14*c* reach the shafts 16*b*, 16*c* while causing the plate springs 19*a*, 19*b* to deform, and fit on the shafts 16*b*, 16*c*. The intermediate gears 14*b*, 14*c* are smoothly guided to the shafts 16*b*, 16*c* by the bent sections 21 of the plate springs 19*a*, 19*b*, thereby immediately fitting on the shafts 16*b*, 16*c*. When the intermediate gears 14*b*, 14*c* fit on the shafts 16*b*, 16*c*, the plate springs 19*a*, 19*b* are restored to their original shapes, and face the end faces of the intermediate gears 14*b*, 14*c*, thereby preventing the intermediate gears 14*b*, 14*c* from coming off the shafts 16*b*, 16*c*. The plate springs 19*a*, 19*b* are not employed for the first and fourth intermediate gears 14*a*, 14*d*, however, the intermediate gears

14*a*, 14*d* also may be configured so as to be retained by a plate spring as in the case of the other intermediate gears 14*b*, 14*c*.

The shafts 16*b*, 16*c* may be formed alternatively. As shown in FIG. 8B, an oblique surface 22*a*, which is slanted in the direction opposite to that of the bent section 21 of the plate spring 19*b*, may be formed on the tip end of a shaft 22. The oblique surface 22*a* and the bent section 21 of the plate spring 19*b* form a V-shaped guide face. Accordingly, when the intermediate gears 14*b*, 14*c* are attached to the shafts 22, the intermediate gears 14*b*, 14*d* are smoothly guided to the shafts 22, thereby being fitted on the shafts immediately.

Figure 4:
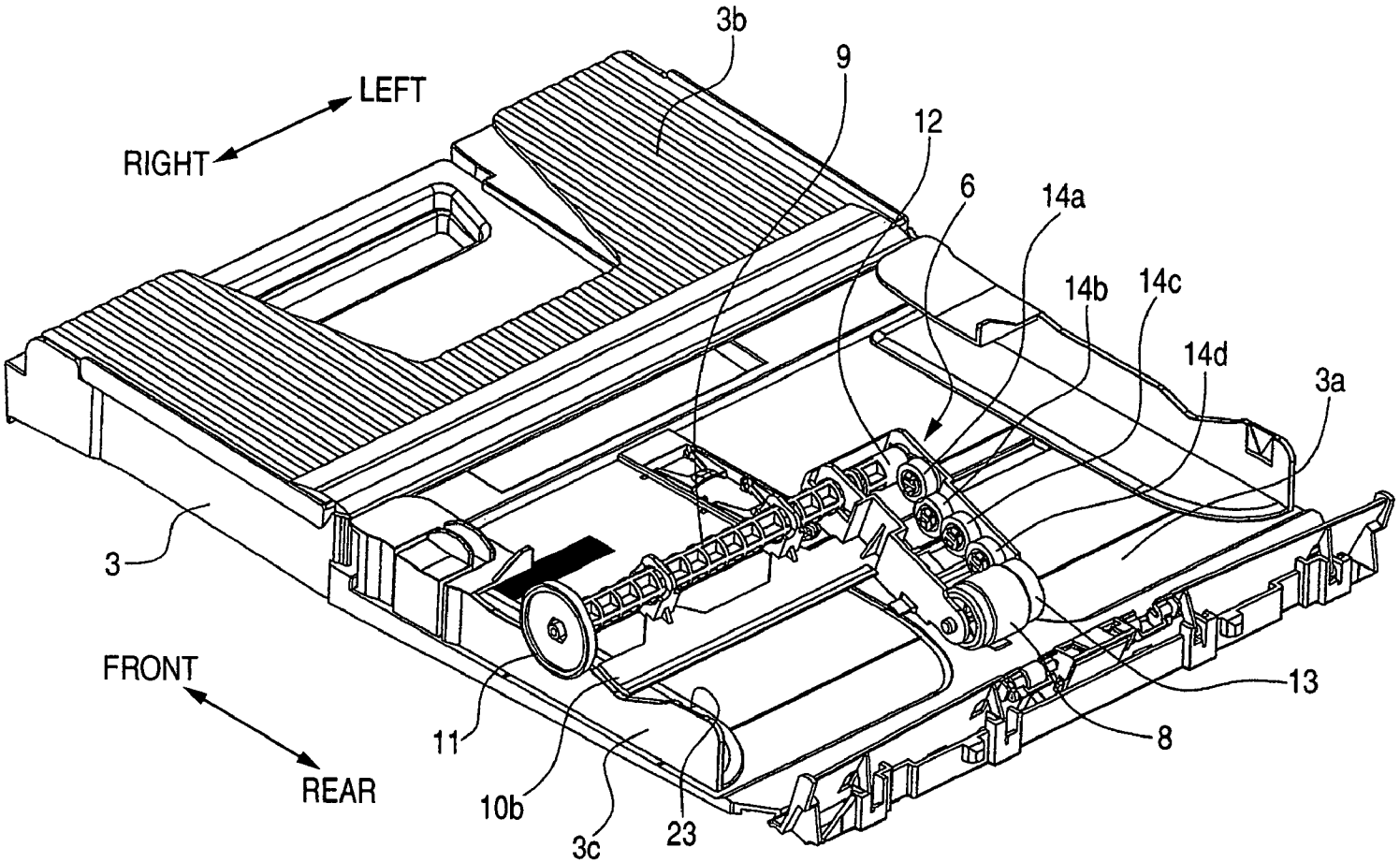
FIG. 4 is a perspective view showing the sheet feed cassette together with the sheet feeder.

As shown in FIG. 4, a cam 23 is formed on the side wall 3*c* of the sheet feed cassette 3, and a cam follower 10*b* is attached to the arm 10. When the sheet feed cassette 3 is removed from the case 1 after driving of the sheet feeder is stopped, and the like, as shown in FIGS. 9A to 9D, the cam 23 raises the sheet feed roller 8 to a position above the sheet feed cassette 3 by way of the cam follower 10*b*. According to the above configuration, collision between the sheet feed roller 8 and the sheet feed cassette 3 at the time of insertion or removal of the sheet feed cassette 3 is prevented.

Next, the operations of the sheet feeder configured as above will be described.

Figure 8A:
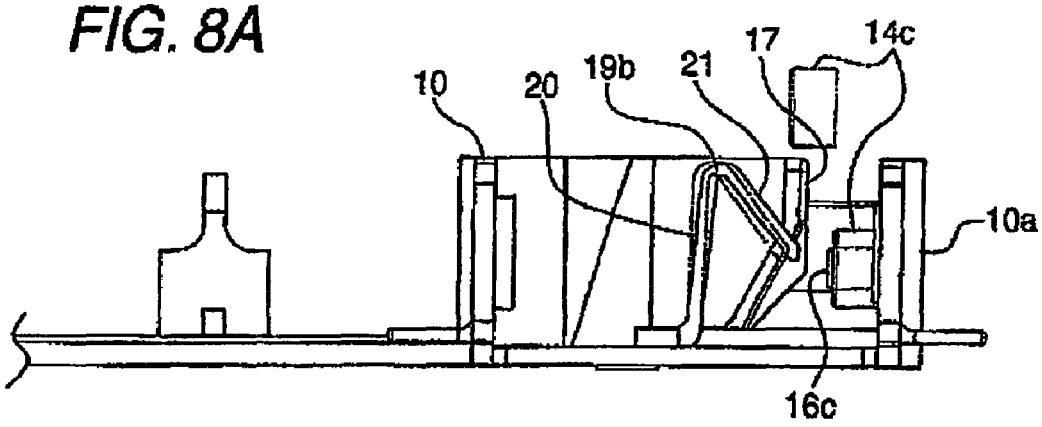
FIG. 8A is a partially cutaway view showing a process where a gear is attached to the arm of the sheet feeder.
Figure 8B:
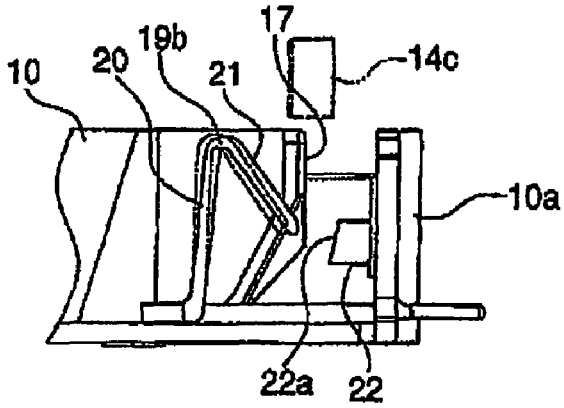
FIG. 8B is a partially cutaway view showing a process where a gear is attached to an arm according to a modification of the invention.
Figure 9A:
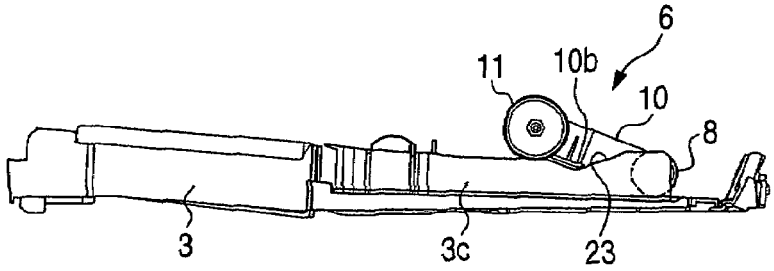
FIGS. 9A through 9D are views for explaining motions of the sheet feeder when the sheet feed cassette is removed or inserted.
Figure 9B:
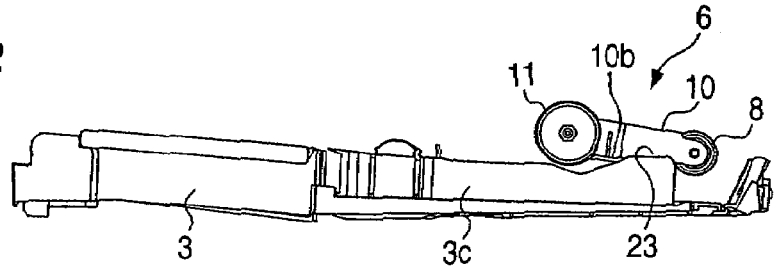
Figure 9C:
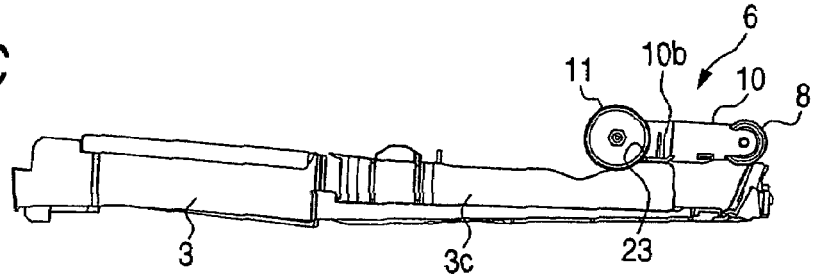
Figure 9D:
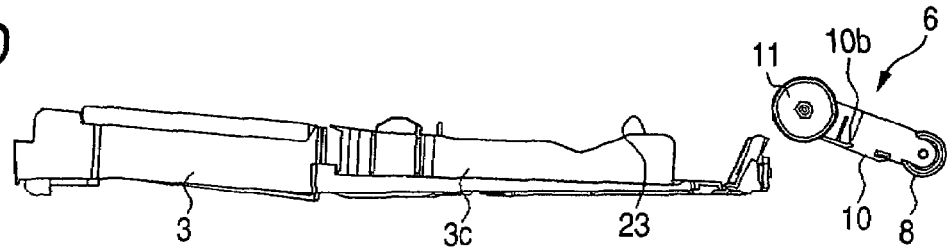

In the course of assembly of the sheet feeder 6, the intermediate gears 14*b*, 14*c* are pressed between the plate springs 19*a*, 19*b* and the shafts 16*b*, 16*c* as shown in FIG. 8A, to thus attach the intermediate gears 14*b*, 14*d* to the arm 10. The intermediate gears 14*b*, 14*c* deform the plate springs 19*a*, 19*b* while sliding along the slantingly bent sections 21 of the plate springs 19*a*, 19*b*, thereby fitting on the shafts 16*b*, 16*c*. After the intermediate gears 14*b*, 14*c* fit on the shafts 16*b*, 16*c*, the plate springs 19*a*, 19*b* are restored to their original shapes, and face the end faces of the intermediate gears 14*b*, 14*c* so that the intermediate gears 14*b*, 14*c* will not come off the shaft 16*b*, 16*c*.

The sheet feeder 6 is assembled in the case 1 as shown in FIG. 2, thereby performing paper feeding to the recording section 7.

In a case where the printer performs recording the drive shaft 9 rotates clockwise in FIGS. 2 and 6B and the leading gear 12 also starts clockwise rotation integrally with the drive shaft 9. By virtue of the above configuration, the arm 10 and the carrier 15 rotate clockwise in a linked manner. Accordingly, as shown in FIG. 6B, the first intermediate gear 14*a* comes into engagement with the second intermediate 14*b*; and the arm 10 rotates downward about the drive shaft 9 serving ea a pivot. The sheet feed roller 8 on the tip end of the arm 10 is brought into contact with the sheets A in the sheet feed cassette 3 as shown in FIG. 2 and rotates upon transmission of power from the drive shaft 9, thereby feeding a single sheet of the sheets A at a time out of the sheet feed cassette 3. The protrusions 15*a* on the carrier 15 side are engaged in the arc grooves 18 on the arm 10 side. Accordingly, the sheet feed roller 8 is vertically displaced together with the arm 10 in accordance with a height of a stack of the sheets A in the sheet feed cassette 3.

A leading edge of the sheet of the sheet A having been fed from the sheet feed roller 8 is pinched by the guide rollers 7*a* of the recording section 7, pulled into the recording section 7, and a predetermined image is recorded on its surface. The sheet A on which the image has been recorded is discharged onto the tray 3*b* in the sheet feed cassette 3 by means of the discharge rollers 7*b*.

When the sheet feed cassette 3 is taken out of the case 1 in a case where the sheet A in the sheet feed cassette 3 has been consumed or the like, as shown in FIGS. 9A to 9D, the cam 23 on the side wall 3*c* of the sheet feed cassette 3 pulls up the arm 10 by way of the cam follower 10*b*. By virtue of the above configuration, the sheet feed cassette 3 can be pulled out of the case 1 without colliding with the sheet feed roller 8. In addition, similarly, the sheet feed cassette 3, which has been refilled with the sheets A, is inserted into the case 1 without colliding with the sheet feed roller 8.

In a case where the printer stops, the drive shaft 9 rotates counterclockwise in FIGS. 2 and 6B, and the leading gear 12 also starts to rotate counterclockwise integrally with the drive shaft 9. By virtue of the above configuration, the carrier 15 is caused to rotate counterclockwise in a linked manner, whereby, as shown in FIG. 6A, the first intermediate gear 14*a* is separated from the second intermediate gear 14*b*, to thus interrupt transmission of power to the sheet feed roller 8. Furthermore, each of the protrusions 15*a* on the carrier 15 side hits one end of the corresponding arc groove 18, thereby raising the arm 10 to its uppermost position as shown in FIG. 6A. As a result, the arm 10 is stored in the frame 5 together with the sheet feed roller 8 through the opening in the frame 5.

As described above, according to the first embodiment, there is provided a printer including a sheet feeder (6) in which rotating transmission members (14*b*, 14*c*) for transmitting rotation of a drive shaft (9) to a sheet feed roller (8) are supported by means of cantilever shafts (16*b*, 16*c*) on an arm (10) spanning between the drive shaft (9) and the sheet feed roller (8). The elastic members (19*a*, 19*b*) are attached to the arm (10) so as to face end faces of the rotating transmission members (14*b*, 14*c*) on the shafts (16*b*, 16*c*).

The elastic members are plate springs (19*a*, 19*b*) protruding toward the end faces of the rotating transmission members (14*b*, 14*c*).

The elastic members (19*a*, 19*b*) are molded integrally with the arm (10), from a synthetic resin.

The elastic members (19*a*, 19*b*) are molded integrally with the shafts (16*b*, 16*c*) and the arm (10), from a synthetic resin.

The oblique surface (22*a*) for guiding the rotating transmission members (14*b*, 14*c*) at the time of attachment of the rotating transmission members (14*b*, 14*c*) is formed at a tip end of a shaft (22).

According to the first embodiment, rotating transmission member rotating transmission member when the rotating transmission members (14*b*, 14*c*) are inserted between the tip ends of the shafts (16*b*, 16*c*) and the elastic members (19*a*, 19*b*), the rotating transmission members (14*b*, 14*c*) reach the shaft (16*b*, 16*c*) while causing the elastic members (19*a*, 19*b*) to deform, and fit on the shafts (816*b*, 16*c*). When the rotating transmission members (14*b*, 14*c*) fit on the shafts (16*b*, 16*c*), the elastic members (19*a*, 19*b*) are restored to their original shapes, and face the end faces of the rotating transmission members (14*b*, 14*c*), thereby preventing the rotating transmission members (14*b*, 14*c*) from coming off the shafts (16*b*, 16*c*). Therefore, the rotating transmission members (14*b*, 14*c*) can be attached to the arm (10) easily, and, in addition, the structure of the sheet feeder (6) can be simplified.

In the first embodiment, the elastic members are plate springs (19*a*, 19*b*) protruding toward the end faces of the rotating transmission members (14*b*, 14*c*). Accordingly, when the rotating transmission members (14*b*, 14*c*) are inserted between the tip ends of the shafts (16*b*, 16*c*) and the elastic members (19*a*, 19*b*), the rotating transmission members (14*b*, 14*c*) are smoothly guided by the plate springs (19*a*, 19*b*) to the shafts (16*b*, 16*c*), thereby fitting on the shafts (16*b*, 16*c*) immediately.

In the first embodiment, the elastic members (19*a*, 19*b*) are molded integrally with the arm (10), from a synthetic resin. Accordingly, the structure of the sheet feeder (6) is simplified, thereby reducing the number of components.

In the first embodiment, the elastic members (19*a*, 19*b*) are molded integrally with the shafts (16*b*, 16*c*) and the arm (10), from a synthetic resin. Accordingly, the structure of the sheet feeder (6) is further simplified, thereby further reducing the number of the components.

In the first embodiment, an oblique surface (22*a*) is formed at a tip end of a shaft (22) for guiding the rotating transmission members (14*b*, 14*c*) at a time of attachment of the rotating transmission members (14*b*, 14*c*). Accordingly, when the rotating transmission members (14*b*, 14*c*) are inserted between the tip ends of the shafts (16*b*, 16*c*) and the elastic members (19*a*, 19*b*), the rotating transmission members (14*b*, 14*c*) are smoothly guided by the oblique surface (22*a*) to the shaft (22), thereby fitting on the shaft (22) immediately.

Second Embodiment

Hereinbelow, a printer according to a second embodiment will be described in detail. In the following description of the second embodiment, parts the same as those in the first embodiment are denoted by the same reference numerals as those in the first embodiment, and detailed description of the parts will be omitted.

The printer according to the second embodiment has the arm 110 as shown in FIGS. 10-19.

Figure 16:
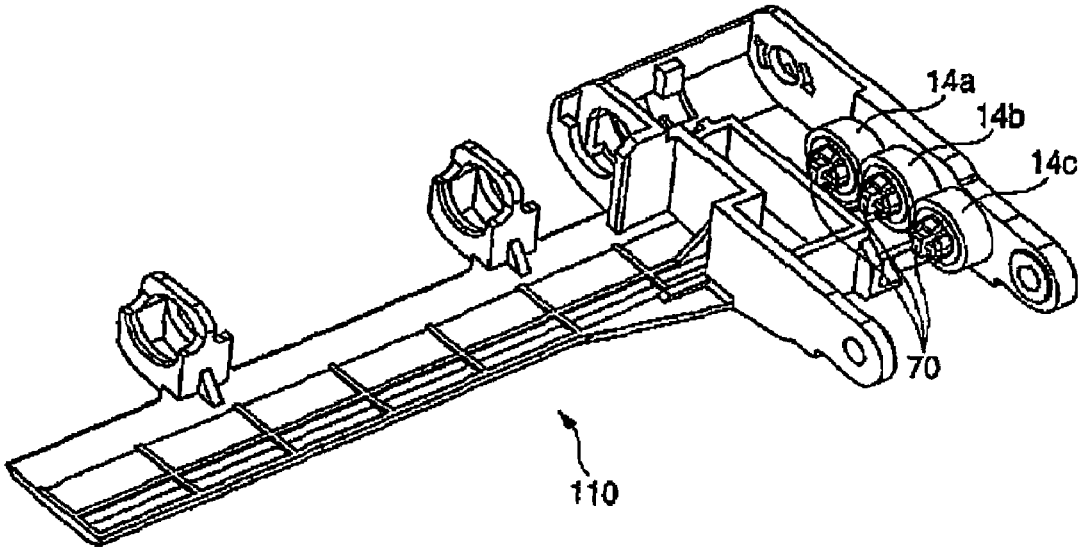
FIG. 16 is a perspective view of the arm where intermediate gears are attached in the shafts.
Figure 17:
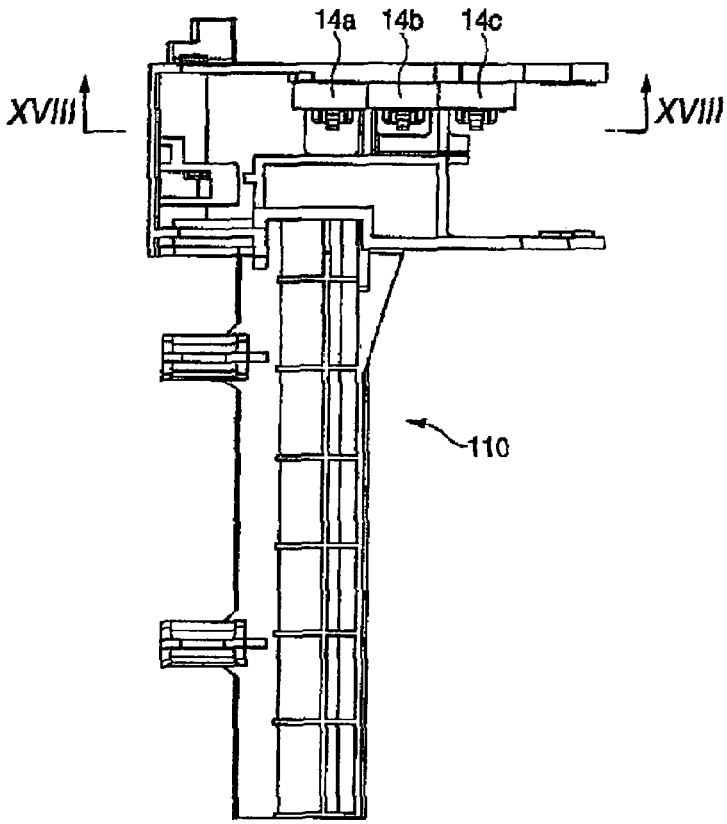
FIG. 17 is a plan view of the arm where intermediate gears are attached in the shafts.
Figure 19:
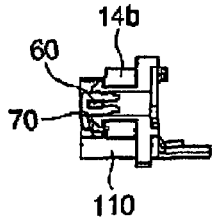
FIG. 19 is a sectional view of the arm taken in XIX-XIX line shown in FIG. 17.
Figure 18:
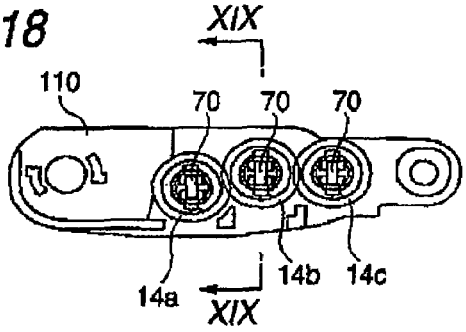
FIG. 18 is a sectional view of the arm taken in XVIII-XVIII line shown in FIG. 17.

As shown in FIGS. 16 and 18, each of the rotating transmission members (intermediate gears 14*a*-14*c*) are formed with a shaft hole in which a corresponding cantilever shaft (shafts 116*a*-116*c*) are inserted.

As shown in FIGS. 10-19, a plurality of elastic members 50 are provided on the arm 10 to protrude in a direction parallel to a direction that the shafts 116*a*-116*c* extend to be inserted into the shaft hole.

Each of the elastic members 50 is provided with a protruded portion 51 at a tip end thereof. Each pair of opposed protruded portions 51 face the end face of the corresponding intermediate gear 14*a*-14*c* to retain the corresponding intermediate gear 14*a*-14*c* in the corresponding shaft 116*a*-116*c*.

In the second embodiment, the elastic members 50 are protruded in the direction that the shafts 116*a*-116*c* extend, and the intermediate gears 14*a*-14*c* are retained in the corresponding shafts 116*a*-116*c* by the protruded portions 51. According to the configuration, the elastic members 50 extend in the direction parallel to the direction of a force that urges the intermediate gears 14*a*-14*c* to come off from the shafts 14*a*-14*c*. Therefore, the elastic members 50 can bear the force more efficiently in comparison with the configuration of the first embodiment.

As shown in FIG. 10-19, each of the protruded portions 51 are formed with an oblique surface 51*a* at a tip and thereof. The oblique surfaces 51*a* guide the intermediate gears 14*a*-14*c* to be attached into the shafts 116*a*-116*c*. According to this configuration, the intermediate gears 14*a*-14*c* can be snapped onto the corresponding shafts 16*a*-16*c*, whereby the assembling workability can be improved.

As shown in FIGS. 10-19, each of a plurality of latches 70 is engaged with an engagement portion 60 formed on the corresponding shaft 116*a*-116*c*. The latch 70 prevents the elastic member 50 from being bent in a direction parallel to a radius direction of the intermediate gears 14*a*-14*c*. According to this configuration, the elastic members 50 become more bearable to the force that urges the intermediate gears 14*a*-14*c* to come off from the shafts 14*a*-14*c*.

Each of the engagement portions 60 is formed on the corresponding shaft 116*a*-116*c* to extend in a radial direction of the corresponding shaft 116*a*-116*c*. Accordingly, the engagement portions 60 improve rigidity of the shafts 116*a*-116*c* and prevent the shafts 116*a*-116*c* from bending in the radial direction at a circumferential peripheral of the shafts 116*a*-116*c*.

In the second embodiment, the elastic members 50 are molded integrally with the arm 110, from a synthetic resin. Accordingly, the structure of the sheet feeder 6 is simplified, thereby reducing the number of components.

In the second embodiment, the elastic members 50 are molded integrally with the shafts 116*a*-116*c* and the arm 110, from a synthetic resin. Accordingly, the structure of the sheet feeder 6 is further simplified, thereby further reducing the number of the components.

Figure 10:
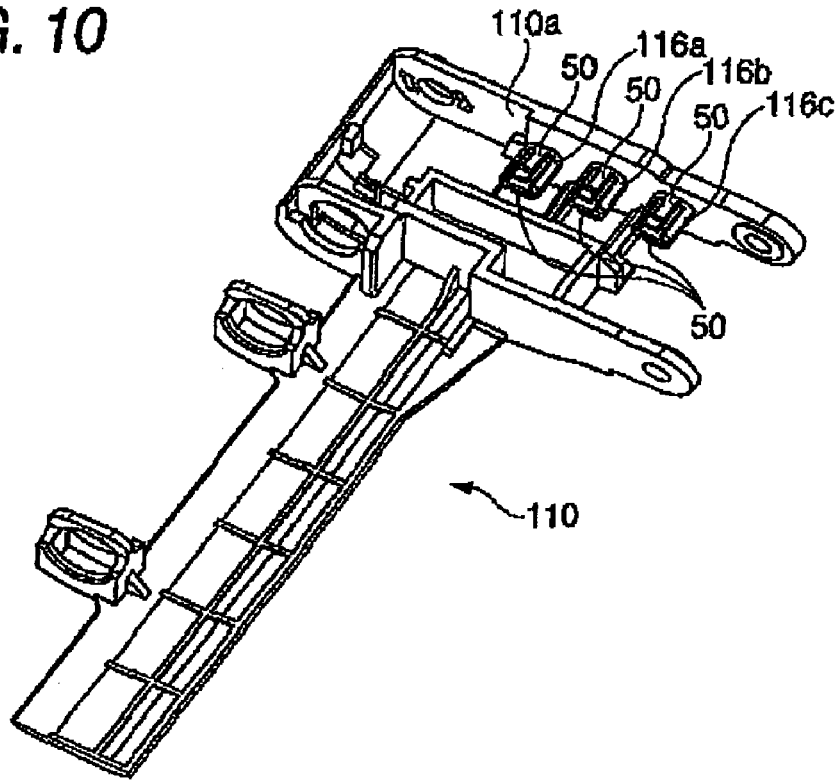
FIG. 10 is a perspective view of an arm according to a second embodiment.
Figure 11:
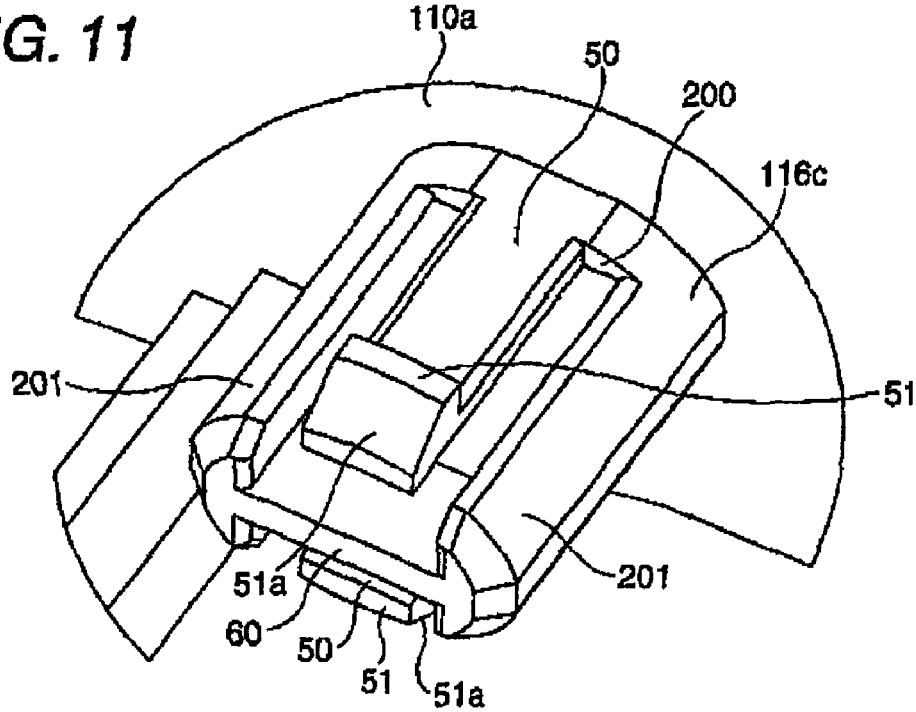
FIG. 11 is an enlarged view of a shaft.
Figure 12:
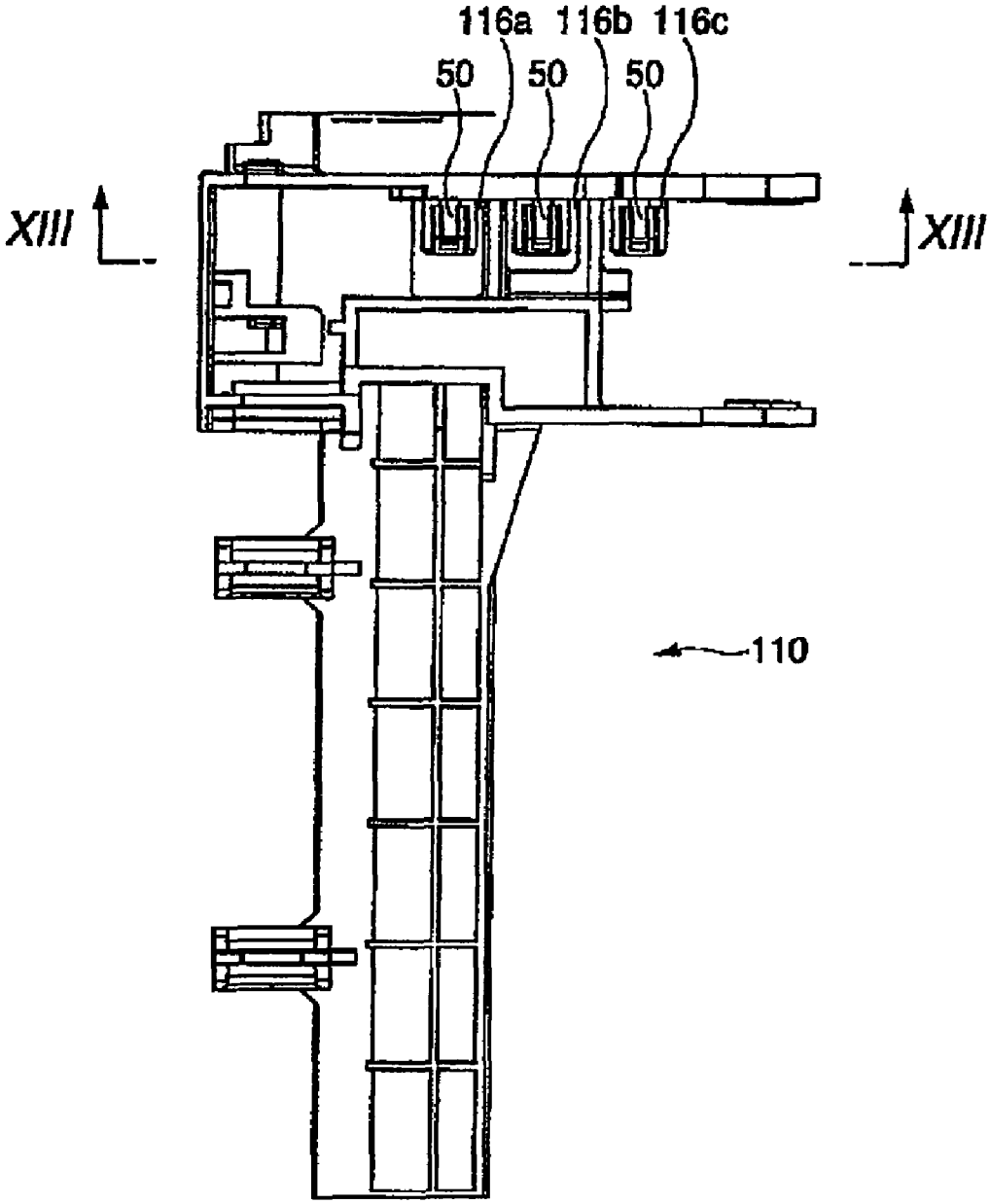
FIG. 12 is a plan view of the arm.
Figure 14:
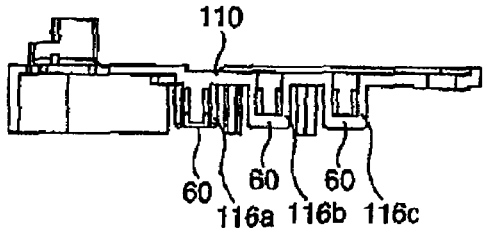
FIG. 14 is a sectional view of the arm taken in XIV-XIV line shown in FIG. 13.
Figure 15:
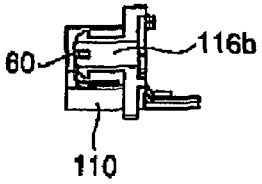
FIG. 15 is a sectional view of the arm taken in XV-XV line shown in FIG. 13.
Figure 13:
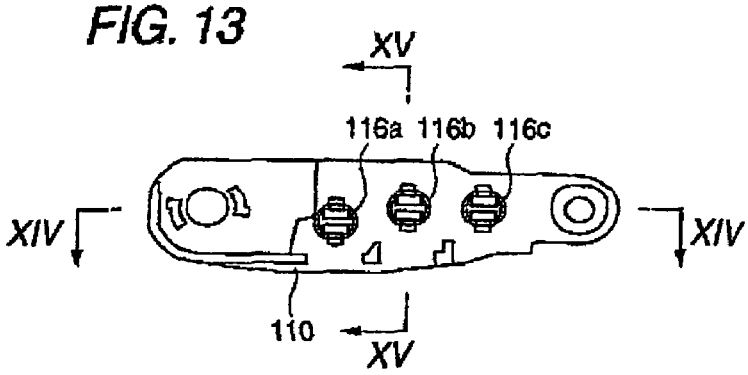
FIG. 13 is a sectional view of the arm taken in XIII-XIII line shown in FIG. 12.

As shown in FIGS. 10 and 11, each of the shafts 116*a*-116*c* has a cylindrical base portion 200 connected to an inner surface 110*a* of the arm 110. The arm 110 is provided with pairs of opposed elastic members 50 that extend from the base portion 200 perpendicularly to the inner surface 110*a* of the arm 110. Each of the elastic members 50 faces the end face of the corresponding intermediate gear 14*a*-14*c*.

Each of the shafts 116*a*-116*c* has a pair of opposed peripheral portions 201 that extend from the base portion 200 perpendicularly to the inner surface 110*a* of the arm 110, and the engagement portion (beam) 60 that bridges the opposed peripheral portions 201. Each of the intermediate gears 14*a*-14*c* is fitted around the corresponding elastic members 50 and the corresponding peripheral members 201.

In the second embodiment, each of the latches 70 is attached to the corresponding engagement portion 60, and prevents the elastic members 50 from being bent in the radial direction (radius direction) of the intermediate gears 14*a*-14*c*.

In the above-described embodiments, an example where the sheet feeder is attached to a printer has been described; however, the sheet feeder can be attached to a copying machine, facsimile machine, or the like. In addition, the embodiments have been described on an assumption that the drive device of the sheet feed roller is a gear system; however, the drive device may be replaced with or used in combination with a belt system, a friction wheel system, or the like. Moreover, the term "cut sheet" has been employed in the description of the embodiment, however, the cut sheet is a concept encompassing a variety of sheets, such as a resin sheet, a laminated sheet of resin, and paper.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet feeder comprising:

a sheet feed roller that abuts against a topmost sheet of stacked sheets and rotates to convey the topmost sheet in a conveyance direction;

an arm spanning across a drive shaft and the sheet feed roller;

a rotating transmission member that transmits rotation of the drive shaft to the sheet feed roller, wherein the arm includes:

a shaft that rotatably supports the rotating transmission member about an axis and includes a free end; and an elastic member that is separated from the shaft in the axis direction and faces an end face of the rotating transmission member to retain the rotating transmission member on the shaft.

2. The sheet feeder according to claim 1, wherein the elastic member is a plate spring that protrudes toward the end face of the rotating transmission member.

3. The sheet feeder according to claim 1, wherein the arm and the elastic member are made of synthetic resin and are molded integrally with each other.

4. The sheet feeder according to claim 3, wherein the arm, the shaft and the elastic member are made of synthetic resin and are molded integrally with each other.

5. The sheet feeder according to claim 2, wherein the shaft is provided with an oblique surface at the free end thereof, the oblique surface guiding the rotating transmission member to be attached into the shaft.

6. The sheet feeder according to claim 2, wherein the arm is shaped like a box, wherein the rotating transmission member, the shaft, and the elastic member are accommodated in the arm, and wherein the shaft is formed on an inner surface of the arm.

7. The sheet feeder according to claim 1, wherein the rotating transmission member rotates about the shaft.

8. The sheet feeder according to claim 7, wherein the elastic member faces the rotating transmission member from an opposite side of the free end of the shaft.

9. A sheet feeder comprising:

a sheet feed roller that abuts against a topmost sheet of stacked sheets and rotates to convey the topmost sheet in a conveyance direction;

an arm spanning across a drive shaft and the sheet feed roller;

a rotating transmission member that transmits rotation of the drive shaft to the sheet feed roller, wherein the arm is provided with a cantilever shaft that rotatably supports the rotating transmission member, and an elastic member that faces an end face of the rotating transmission member to retain the rotating transmission member on the cantilever shaft, wherein the rotating member is formed with a shaft hole in which the cantilever shaft is inserted, and wherein the cantilever shaft is positioned within the shaft hole in a radial direction of the rotating transmission member.

10. The sheet feeder according to claim 9, wherein the rotating transmission member is formed with a shaft hole in which the cantilever shaft is inserted, wherein the elastic member is provided on the arm to protrude in a direction parallel to a direction that the cantilever shaft extends to be inserted into the shaft hole, and wherein the elastic member is provided with a protruded portion at a tip end thereof, the protruded portion facing the end face of the rotating transmission member to retain the rotating transmission member in the cantilever shaft.

11. The sheet feeder according to claim 10, wherein the protruded portion is formed with an oblique surface at a tip end thereof, the oblique surface guiding the rotating transmission member to be attached into the cantilever shaft.

12. The sheet feeder according to claim 10, further comprising a latch that prevents the elastic member from being bent, wherein the cantilever shaft is provided with an engagement portion to which the latch is engaged.

13. The sheet feeder according to claim 9, wherein the cantilever shaft is formed on an inner surface of the arm, and wherein the cantilever shaft has a cylindrical base portion connected to the inner surface of the arm, and wherein the arm is provided with a pair of opposed elastic members that extend from the base portion perpendicularly to the inner surface of the arm, each of the elastic members facing the end face of the rotating transmission member.

14. The sheet feeder according to claim 13, wherein the cantilever shaft has a pair of opposed peripheral portions that extend from the base portion perpendicularly to the inner surface of the arm, and a beam that bridges the peripheral portions, and wherein the transmission rotating member is fitted around the elastic members and the peripheral members.

15. The sheet feeder according to claim 14, further comprising a latch that engages the beam, wherein the latch prevents the elastic members from being bent.

16. The sheet feeder according to claim 9, wherein the cantilever shaft does not include a portion extending outside in the radial direction of the rotating transmission member.

17. A rotator supporting structure comprising:

a rotator;

a wall including a projection which is configured to support the rotator; and an elastic member which includes a contactable point and which is elastically deformable between a first state in which a distance between the contactable point of the elastic member and the projection is smaller than a width of the rotator in an axial direction of the rotator and a second state in which the distance between the contactable point of the elastic member and the projection is larger than the width of the rotator in the axial direction of the rotator.

18. The rotator supporting structure according to claim 17, wherein in the first state, the elastic member holds the rotator on the projection with the contactable point, and wherein in the second state, the elastic member is deformed such that the rotator is attachable to the projection.

19. The rotator supporting structure according to claim 17, wherein the rotator rotates about the projection.

* * * * *